US008302538B2

(12) United States Patent
Cencer et al.

(10) Patent No.: US 8,302,538 B2
(45) Date of Patent: Nov. 6, 2012

(54) METHOD OF SHIPPING AUTOMOBILES, RAILCAR FOR SHIPPING AUTOMOBILES, AND METHOD OF MANUFACTURING RAILCARS

(75) Inventors: Robert James Cencer, Tipton, MI (US); Robert C. Ortner, Jr., Johns Creek, GA (US)

(73) Assignee: Trinity Industries, Inc., Dallas, TX (US)

( * ) Notice: Subject to any disclaimer, the term of this patent is extended or adjusted under 35 U.S.C. 154(b) by 429 days.

(21) Appl. No.: 12/506,686

(22) Filed: Jul. 21, 2009

(65) Prior Publication Data

US 2011/0017094 A1 Jan. 27, 2011

(51) Int. Cl.
*B61D 3/00* (2006.01)

(52) U.S. Cl. ..... 105/355; 105/404; 410/26

(58) Field of Classification Search ..... 105/355, 105/396, 404, 1.4, 3, 4.1, 340; 410/26, 87; 52/45

See application file for complete search history.

(56) References Cited

U.S. PATENT DOCUMENTS

| | | | | |
|---|---|---|---|---|
| 1,946,013 | A | 2/1934 | Campbell | |
| 2,668,734 | A | 2/1954 | Bridge | |
| 2,929,339 | A | 3/1960 | Schueder et al. | |
| 3,119,350 | A | 1/1964 | Bellingher | |
| 3,180,283 | A | 4/1965 | Sharp | |
| 3,230,900 | A | 1/1966 | Ruprecht et al. | |
| 3,240,167 | A | 3/1966 | Podesta et al. | |
| 3,370,311 | A * | 2/1968 | Demos | 14/69.5 |
| 3,370,552 | A | 2/1968 | Podesta et al. | |
| 3,405,661 | A | 10/1968 | Erickson et al. | |
| 3,547,049 | A | 12/1970 | Sanders | |
| 3,595,176 | A | 7/1971 | Broling | |
| 3,690,272 | A | 9/1972 | Ogle et al. | |
| 3,815,517 | A | 6/1974 | Przybylinski | |
| 3,875,871 | A | 4/1975 | Thornton et al. | |
| 3,895,587 | A | 7/1975 | Bell | |
| 3,927,621 | A | 12/1975 | Skeltis et al. | |
| 3,938,446 | A | 2/1976 | Seitz et al. | |
| 4,067,469 | A | 1/1978 | Biaggini et al. | |

(Continued)

FOREIGN PATENT DOCUMENTS

CA 2 416 090 A1 7/2003

(Continued)

*Primary Examiner* — Mark Le

(74) *Attorney, Agent, or Firm* — Fitch, Even, Tabin & Flannery, LLP

(57) ABSTRACT

A method of shipping automobiles, a railcar for shipping automobiles, and a method of manufacturing railcars for shipping automobiles. The method comprises, among other steps, determining a distribution of vehicle heights for passenger cars sold within a predetermined area and a predetermined time period; assessing weight, bottom clearance, length, width and Cg for the passenger cars; and transporting the passenger cars on a plurality of single-unit tri-level auto rack railcars, each comprising a flat car and a fixed-deck rack built on the flat car. Each of the railcars has (a) three decks which are fixed along their entire lengths and which are capable of transporting in commercial rail service over 90% of passenger cars manufactured in the predetermined area and predetermined time period with a load factor of at least 15 with minimum vertical clearances of between 64 and 66 in. to accommodate the vehicle heights of the passenger cars, while also accommodating at least 3 in. of vertical displacement of the vehicles on their suspension systems on all three decks, and (b) substantially horizontal deck configurations to meet ground clearance requirements for the passenger cars on all 3 decks.

12 Claims, 7 Drawing Sheets

U.S. PATENT DOCUMENTS

| | | | | |
|---|---|---|---|---|
| 4,116,135 | A | 9/1978 | Jaekle et al. | |
| 4,154,348 | A | 5/1979 | Biaggini et al. | |
| 4,668,141 | A | 5/1987 | Petersen | |
| 4,668,142 | A | 5/1987 | Fity et al. | |
| 4,751,883 | A | 6/1988 | Bealer | |
| 4,759,668 | A | 7/1988 | Larsen et al. | |
| 4,898,418 | A | 2/1990 | Lind, Sr. et al. | |
| 4,963,067 | A | 10/1990 | Gearin et al. | |
| 5,040,935 | A | 8/1991 | Gearin et al. | |
| 5,040,938 | A | 8/1991 | Gearin et al. | |
| 5,105,951 | A | 4/1992 | Gearin et al. | |
| 5,239,933 | A | 8/1993 | Murphy et al. | |
| 5,307,744 | A | 5/1994 | Newman et al. | |
| 5,320,046 | A | 6/1994 | Hesch | |
| 5,415,108 | A | 5/1995 | Murphy et al. | |
| 5,579,697 | A | 12/1996 | Burke | |
| 5,622,115 | A | 4/1997 | Ehrlich et al. | |
| 5,685,228 | A | 11/1997 | Ehrlich et al. | |
| 5,687,650 | A | 11/1997 | Murphy et al. | |
| 5,701,825 | A | 12/1997 | Peach, Jr. | |
| 5,743,192 | A | 4/1998 | Saxton et al. | |
| 5,794,537 | A | 8/1998 | Zaerr et al. | |
| 5,832,836 | A | 11/1998 | Ehrlich et al. | |
| 5,979,335 | A | 11/1999 | Saxton et al. | |
| 6,138,579 | A | 10/2000 | Khattab | |
| 6,205,932 | B1 | 3/2001 | Khattab | |
| 6,244,801 | B1 | 6/2001 | Klag et al. | |
| 6,273,004 | B1 | 8/2001 | Klag | |
| 6,283,040 | B1 * | 9/2001 | Lewin | 105/404 |
| 6,446,561 | B1 | 9/2002 | Khattab | |
| 6,551,039 | B1 | 4/2003 | Forbes | |
| 6,553,917 | B1 * | 4/2003 | Burke et al. | 105/355 |
| 6,821,065 | B2 | 11/2004 | Forbes | |
| 6,845,722 | B2 | 1/2005 | Forbes | |
| 7,055,441 | B2 | 6/2006 | Jarvis | |
| 7,094,013 | B2 | 8/2006 | Hart et al. | |
| 7,360,979 | B2 | 4/2008 | Forbes | |
| 2001/0035108 | A1 | 11/2001 | Klag | |
| 2003/0129037 | A1 | 7/2003 | Forbes | |
| 2003/0200895 | A1 | 10/2003 | Forbes et al. | |
| 2004/0016362 | A1 | 1/2004 | Cencer et al. | |
| 2004/0173118 | A1 | 9/2004 | Forbes | |
| 2004/0187730 | A1 | 9/2004 | Jarvis | |
| 2004/0250725 | A9 | 12/2004 | Forbes | |
| 2005/0031430 | A1 | 2/2005 | Hart et al. | |
| 2005/0061763 | A1 | 3/2005 | Forbes | |
| 2005/0126426 | A1 | 6/2005 | Forbes | |
| 2006/0219129 | A1 | 10/2006 | Jarvis | |
| 2006/0269379 | A1 | 11/2006 | Orr et al. | |
| 2007/0020060 | A1 | 1/2007 | Hart et al. | |
| 2007/0227395 | A1 | 10/2007 | Zaerr | |
| 2007/0264097 | A1 | 11/2007 | Fellon et al. | |

FOREIGN PATENT DOCUMENTS

| | | | |
|---|---|---|---|
| EP | 0 338 020 | A1 | 10/1989 |
| EP | 0 788 958 | A2 | 8/1997 |
| EP | 0 788 959 | A2 | 8/1997 |
| EP | 0 904 979 | A1 | 3/1999 |
| GB | 397110 | A | 8/1933 |
| GB | 754947 | A | 8/1956 |
| WO | WO 88/05001 | A1 | 7/1988 |
| WO | WO 96/25304 | A1 | 8/1996 |
| WO | WO 00/69677 | A1 | 11/2000 |
| WO | WO 02/22394 | A1 | 3/2002 |
| WO | WO 02/076804 | A1 | 10/2002 |
| WO | WO 03/016118 | A1 | 2/2003 |
| WO | WO 03/024761 | A1 | 3/2003 |

* cited by examiner

METHOD OF SHIPPING AUTOMOBILES, RAILCAR FOR SHIPPING AUTOMOBILES, AND METHOD OF MANUFACTURING RAILCARS

BACKGROUND

The invention relates generally to railcars, and more particularly to railcars for shipping automotive vehicles.

For many years, bi-level and tri-level autorack railcars have been used to ship new automotive vehicles from their places of manufacture to distribution centers. Shipping by rail can significantly reduce the cost of shipping such vehicles over long distances as compared with shipping by tractor-trailer.

One factor that limits the number of vehicles that can be shipped on an individual railcar is the height limit imposed on railcars due to the presence of bridges, tunnels and other obstructions over the railways. Another limiting factor is the need to maintain the center of gravity of the loaded railcar at or below a certain height above the top of the rail (ATR) for stability.

While bi-level autorack railcars generally are used to provide adequate clearance to ship certain vehicles such as pick-up trucks, mini-vans and sport utility vehicles, tri-level railcars are typically preferred for shipping passenger cars with lower vertical dimensions. The additional deck enables a larger number of automobiles to be shipped on a single railcar, thus increasing load factor and lowering the cost of transportation.

Many tri-level railcars have been constructed by building racks on flat cars. In some cases, the racks may be built on new flat cars that are custom built for auto rack use. In other cases, the racks may be built on flat cars that have been built and used previously for other commercial rail service. In the latter case, the flat cars may exhibit configurational variation as a result of strain incurred while in service. This may impose challenges relating to constructions of the racks, but nevertheless may be more desirable than using new flat cars, for economic and/or environmental reasons. In either case, the deck of the flat car functions as the first deck of the tri-level car, and the second and third decks are supported by the rack. The first, second, and third decks are commonly referred to as the A, B, and C decks respectively.

FIGS. 1 and 2 illustrate a prior art flat car of a type that has been used for auto rack service. The flat car comprises a center sill (a), side sills (b) and A-deck (c). A draft gear housing (d) protrudes above the deck at each end of the railcar. Locations at which auto rack posts are to be attached are indicated at (e).

One of the challenges in adapting flat cars for tri-level auto rack use is that a low flat car deck height has been considered necessary for Cg purposes and overhead clearance purposes, but a low deck height creates bottom clearance issues relative to the draft gear housing (d). The bottom clearance issues have typically been addressed through the use of ramps near the ends of the flat car, as shown schematically for purposes of example in FIG. 3, which raise the deck height near the ends of the flat car. Such ramps enable the flat car deck to have a central low portion along most of its length, providing a sufficiently low Cg for the loaded railcar, while providing adequate bottom clearance for most automotive vehicles to clear the draft gear housing near the ends. In the example shown in FIG. 3, each ramp comprises a generally horizontal raised end section (f) that may be, e.g., about 38 in. ATR, a first sloped section (g) having a horizontal dimension of about 5 ft., a generally horizontal raised intermediate section (h) that has a horizontal dimension of, e.g., about 4 ft. and is lower than section (f) by a height differential (k) which may be, e.g., about 4 to 5 in.; a second sloped section (i), that has a horizontal dimension of about 2 ft., and a generally horizontal center section (j) that is lower than section (h) by a height differential (l) which may be e.g., about 2 in.

The B and C decks are at a generally uniform elevation along the length of the car. The clearance over the A-deck is accordingly greater along the central portion and may be lower by, e.g., 6 to 7 in. along the end portions. The A-deck cannot accommodate certain automobiles with low ground clearance due to the transitions or ramps into and out of the central portion.

While bi-level auto rack railcars in the past have had generally horizontal A-decks, the provision of the low central portion in tri-level auto racks has been considered necessary and important not only from the standpoint of providing adequate clearance, but also from the standpoint of stability, so that the center of gravity of the loaded car is sufficiently low. In some tri-level railcars, at least three vehicles are required to be transported on a low central portion of the A-deck to ensure a sufficiently low center of gravity when the B and C decks are fully loaded.

During loading and unloading of automotive vehicles on the A-deck, sufficient clearance greater than the height of the automotive vehicles must be provided between the uppermost surfaces of the automobiles on the A-deck and the bottom surface of the B-deck to allow for vertical displacement or "bouncing" of the vehicles on their suspension systems as they are driven up and down the ramps near the ends of the A-deck. Tri-level cars have hinged end sections on their B decks that can be raised to provide clearance for automobiles being loaded on the A-deck. The hinged end sections are manually raised and lowered during loading and unloading operations. The hinged end sections must be in their lowered positions to support automobiles thereon.

In tri-level cars heretofore used in commercial rail service, adequate clearance is generally not maintained if the same number of vehicles are loaded on the A-deck as on the B and C-decks, requiring a reduced number of vehicles to be transported on the A-deck. While the B and C-decks can generally accommodate five typical passenger cars each in a conventional tri-level railcar, the A-deck can typically carry only four. The load factor for conventional tri-level railcars is 14 for the majority of passenger cars. Where four vehicles are carried on the A-deck, the automobiles in the end positions typically are inclined due to their location on the ramps.

With conventional tri-level cars, shippers must spend significant amounts of time determining the load makeup of a shipment. Load makeup refers to the specific types of vehicles loaded at specific positions in a railcar. Because conventional tri-level cars have different clearances on different decks and at different positions within individual decks, only specific types of automobiles can be loaded at specific positions. Thus, loading a conventional tri-level car entails locating vehicles that can fit within each position and arranging all of the vehicles on the car to use the available capacity efficiently. In some cases, if no automobiles are being shipped that fit within a particular position, the position remains empty, which can increase the number of railcars required to ship a particular number of automobiles.

As consumers' preferences among different types of automobiles fluctuate due to economic factors such as changes in fuel prices as well as non-economic factors, the mix of automobiles being shipped by rail changes and the demand for various types of vehicle-carrying railcars fluctuates, as do the load makeup decisions. Shipping by rail remains the most cost-efficient method of transporting most vehicles over long distances, and autorack railcar design has improved over the years to enable autorack railcars to transport automobiles more securely and efficiently. However, there remains a need for further improvements in methods for transport of automotive vehicles by rail, and in the auto rack railcars themselves, as well as in methods of manufacturing auto rack railcars.

SUMMARY

The center of gravity of the railcar is maintained at an acceptably low elevation while substantially eliminating the conventional height variations and ramps on the A-deck. In some embodiments, this may entail reducing weight in the upper portions of the railcar by using lighter materials than those that have been used in the past in upper portions of the railcar. Elimination of the above-described variations in A-deck height in prior art tri-levels may not only alleviate ground clearance concerns associated with certain high performance automobiles that have lower spoilers, but may also eliminate or reduce the need to provide extra clearance for vertical movement or bouncing associated with the ramps near the ends of the A-deck.

The railcar may comprise a unit car, i.e., a railcar having a monocoque body, or may comprise a rack built on a conventional flat car, an upsill flat car, or a flat car having a 39½ ATR running surface. In one approach where a flat car having a 39½ ATR running surface is employed, the railcar has an overall height of approximately 20'-2". The B and C decks are permanently fixed, i.e. bolted or welded in place along their entire length, rather than having hinged end sections as in the prior art cars discussed above. The A-deck does not include ramps of the type described above which automobiles must travel up or down during loading and unloading, or rest on in an inclined orientation during transportation. The A-deck is substantially horizontal with only minor variations in elevation.

The clearances above each of the three decks preferably are approximately equal. In one approach a minimum clearance of about 64 to 66 in., measured near the deck end 30" off center may be provided for each of the decks. For the C deck, the minimum clearance may need to be measured from the deck to roof-mounted door hardware such as hardware associated with a roof-mounted radial door pivot, which may be as much as 1 to 2 in. below the roof.

In some cases, the rack may be made of conventional materials. In other cases, as mentioned above, the center of gravity Cg may be maintained at an acceptably low elevation by using lighter materials, e.g. by reducing the weights of the side screens of the railcar above the B-deck and/or the roof structure of the railcar by making them thinner and/or making them from a lighter weight material. For example, the roof structure or side screens of the railcar may be made from aluminum, rather than steel, as conventionally used in railcars. Because the side screens and roof generally do not add support to the railcar structure, and are instead used to protect the interior of the railcar from environmental elements and vandals, use of less robust materials at the higher elevations may be acceptable because the screens and roof are not as accessible to potential intruders or vandals.

In another approach to maintaining an acceptably low Cg, the load bearing capacity of the B and C decks, and the loads on fully loaded B and C decks, may be reduced relative to those of conventional tri-level auto rack railcars, enabling lighter structural elements to be employed. In conventional tri-level railcars, the B and C decks are typically rated to a maximum load bearing capacity of approximately 24,000 lbs. According to this approach, the rating of the B and C decks may be reduced below 24,000 lbs. to, for example, approximately 22,000 lbs., to lower the center of gravity of the fully loaded railcar to an acceptably low level, where an acceptably high load factor can be attained without exceeding 22,000 lbs. per deck.

As discussed above, the A-deck preferably does not include conventional ramps as described above with reference to FIG. 3, and may therefore be referred to as "substantially horizontal." This term as used herein is not intended to exclude variations in height across the width of the deck, nor to exclude minor variations in deck height that do not materially affect vertical clearance. The substantially horizontal A-deck facilitates loading automobiles on the A-deck in the same manner as on the B and C decks. Thus, additional clearance is not required above the A-deck to accommodate vehicles being loaded on the A-deck to account for vertical displacement or bouncing of the vehicles traveling up and down conventional end ramps. Thus, an equal number of vehicles can be loaded on the A-deck as on the B and C-decks, increasing the overall load factor of the railcar for most types of automobiles. The substantially horizontal A-deck also accommodates loading sports cars and other vehicles with low ground clearances on the A-deck that could not be loaded on the A-deck of prior art tri-level railcars due to spoilers or other structures near the bottom of the vehicles contacting the A-deck at or near the ramp structures.

Limitations on load makeup may be further reduced by providing approximately equal clearances between all decks to facilitate uniform loading of vehicles in all positions within the railcar, such that vehicles can be loaded in any position in the railcar. Thus, time is saved during loading because a shipper will not need to determine the most efficient load makeup of the railcar to maximize the carrying capacity and ensure that vehicles of varying heights will fit in positions within the railcar having unequal clearances as required with prior art railcars. Additionally, the railcar will not have to be shipped with empty positions as sometimes occurs with prior art tri-levels, when the vehicles to be shipped do not include vehicles for all of the specific positions in the railcar.

DETAILED DESCRIPTION OF PREFERRED EMBODIMENTS

Figure 1:
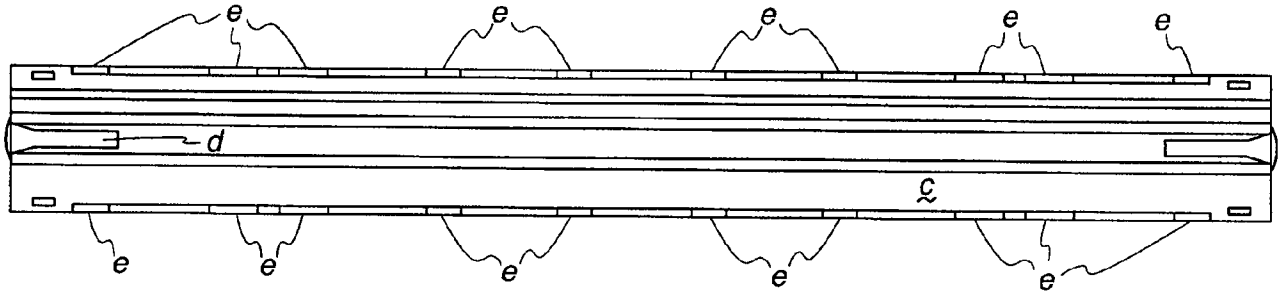
Fig. 1 Prior Art
FIG. 1 is a plan view of a prior art flat car for use in auto rack service.
Figure 2:
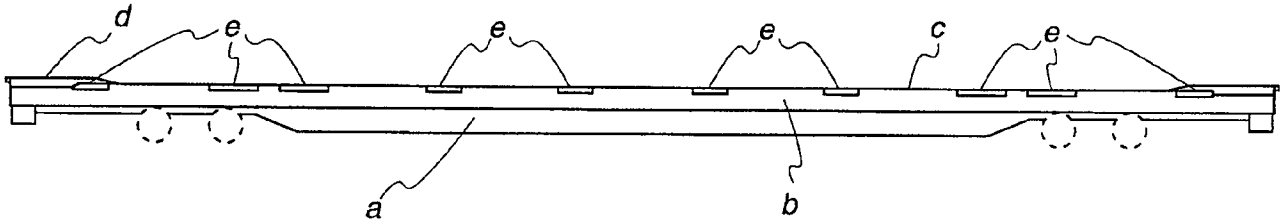
Fig. 2 Prior Art
FIG. 2 is a side elevation of the flat car of FIG. 1.
Figure 3:
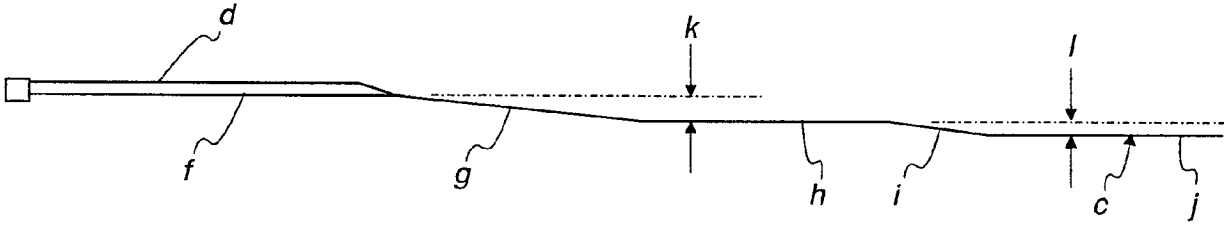
Fig. 3 Prior Art
FIG. 3 is a detail view of an end of a portion of the flat car of FIG. 1.
Figure 4:
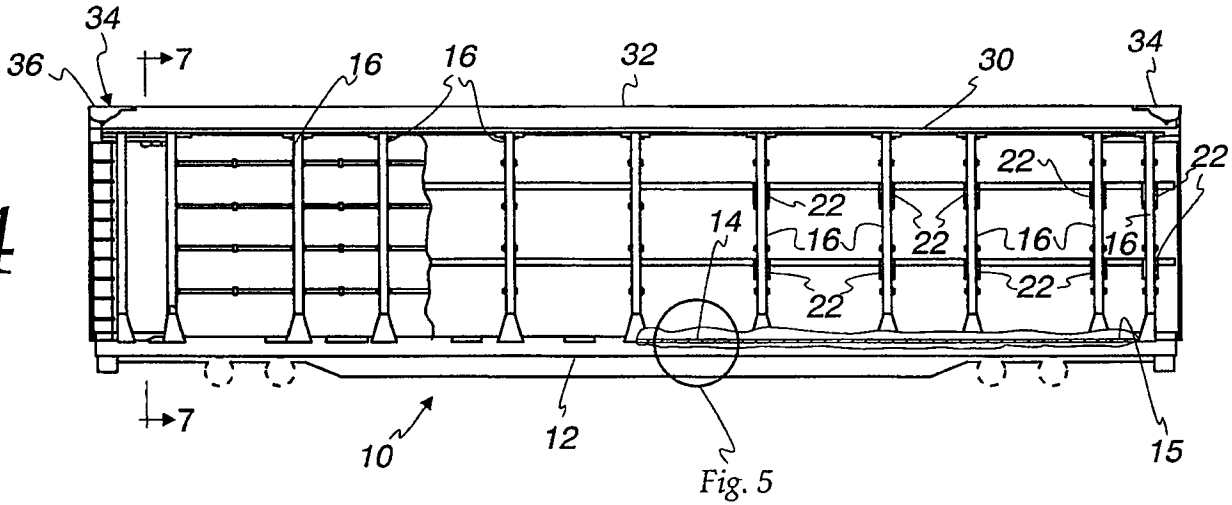
FIG. 4 is a side elevation of a railcar in accordance with an embodiment of the invention.
Figure 5:
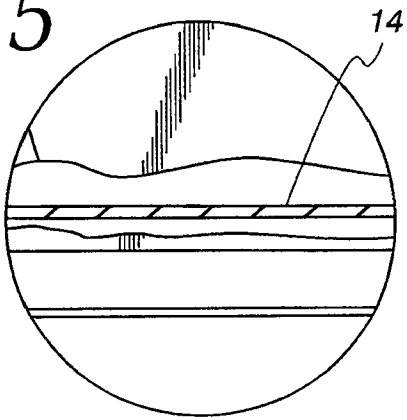
FIG. 5 is a detail view of a portion of the railcar of FIG. 4.
Figure 7:
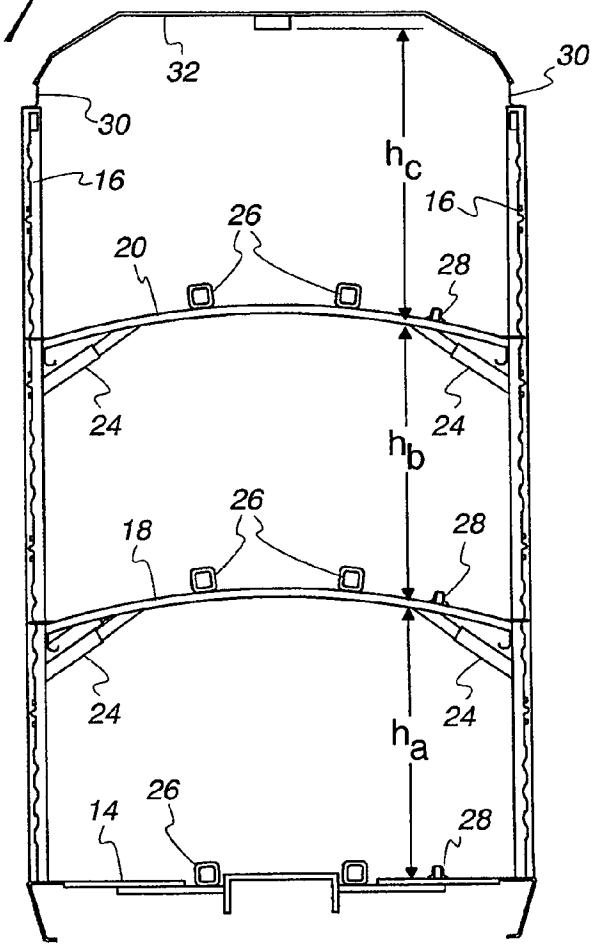
FIG. 7 is a section of the railcar of FIG. 5, taken at lines 7-7 in FIG. 5.
Figure 6:
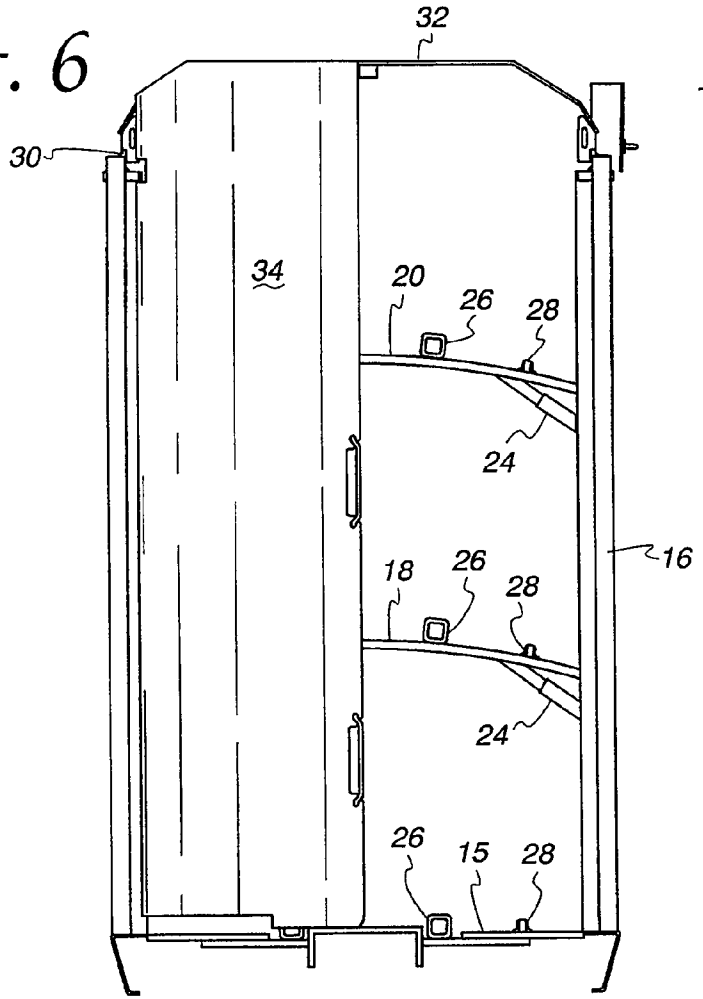
FIG. 6 is an end view of the railcar of FIG. 5.
Figure 8:
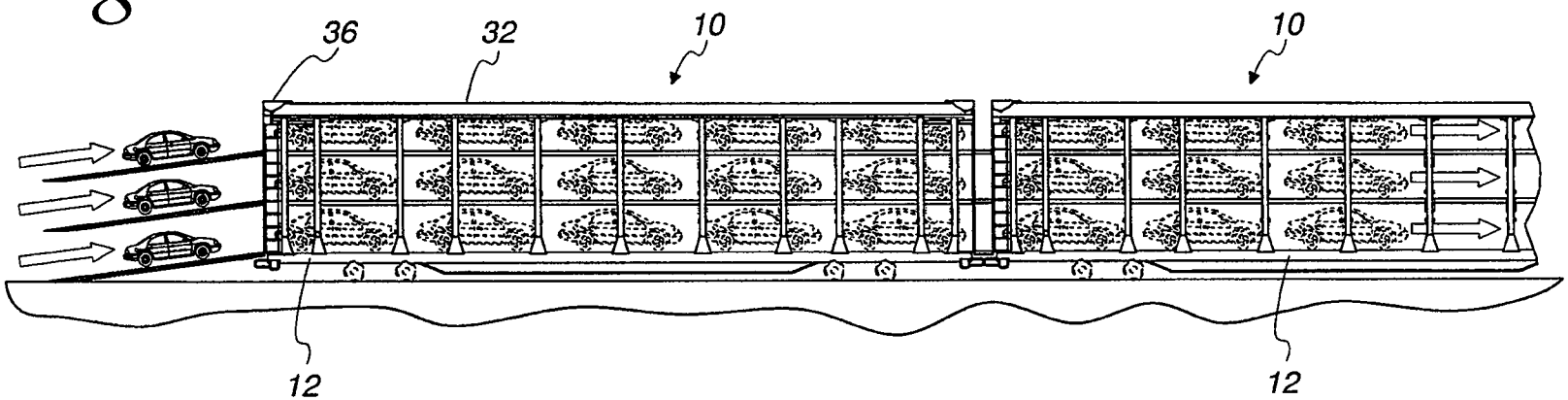
FIG. 8 illustrates a method of loading railcars.

The embodiments described herein comprise a method of shipping automobiles, a railcar for shipping automobiles, and a method of manufacturing railcars for shipping automobiles.

FIGS. 4-8 illustrate a tri-level auto rack railcar 10 that comprises a flat car 12 having a rack structure constructed thereon. The flat car has a deck that functions as the A-deck of the railcar. The A-deck is substantially at the same elevation along its entire length, with a center portion 14 and end portions 15 at substantially the same height. The rack structure comprises a plurality of vertical posts 16, and B and C decks 18 and 20 respectively supported by the posts.

Each of the decks is connected to the posts by vertical plates 22 and knee braces 24. Tire guides 26 and a chock track 28 are provided on each deck. Longitudinal members 30 such as roof rails and/or top chords tie the vertical posts together at their upper ends. A corrugated roof 32 encloses the top of the car. Radial end doors 34 having a top panel 36 overlying an end portion of the roof and pivotally attached thereto are preferably employed at each end of the car.

The B deck 18 is fixed along its entire length, rather than having hinged end sections as in the prior art cars discussed above, so that the B deck contributes to the strength and rigidity of the rack structure. To provide sufficient clearance in the A1 and A5 positions, the B deck is positioned at a higher elevation than in conventional auto rack cars. Minimum clearances of $h_a$, $h_b$ and $h_c$, measured 30" off center are maintained above the A, B and C decks respectively. The minimum clearances are preferably equal, and may be, e.g., between 64 and 66 in. A clearance of may be provided for each of the three decks. Clearances above each of the three decks may be approximately equal.

The railcar may be based on a conventional flat car, an upsill flat car, or a flat car having a 39½" ATR (above top of rail) running surface. To facilitate maintenance of appropriate clearances, high cambered decks are preferably employed at both the B and C level. The overall height of the railcar is preferably equal to the maximum height permissible in North America under applicable AAR regulations, i.e., 20' 2".

Provision of fixed decks facilitates loading in that the all three decks may be continuously loaded and unloaded without the need to stop loading and unloading to pivot the B deck end sections. The ability of the B deck 18 to function as a structural member of the railcar from end to end may eliminate the need for heavier posts at certain locations. In existing auto rack cars, the number 3 and number 4 posts, i.e., the third and fourth posts from the end of the car, are often heavier than other posts. In the illustrated embodiment of the invention, all of the posts may be of the same or similar cross-section.

The method of shipping automobiles described herein enables improved shipping of new automotive vehicles by using assessment of vehicle heights and other relevant parameters for new automotive vehicle sales, and providing railcars that will be capable of transporting newly manufactured automobiles in commercial rail service with an increased load factor for an increased proportion of vehicles, taking into account constraints on overall railcar height, center of gravity (Cg), maximum gross weight, and maximum empty weight.

Figure 9:
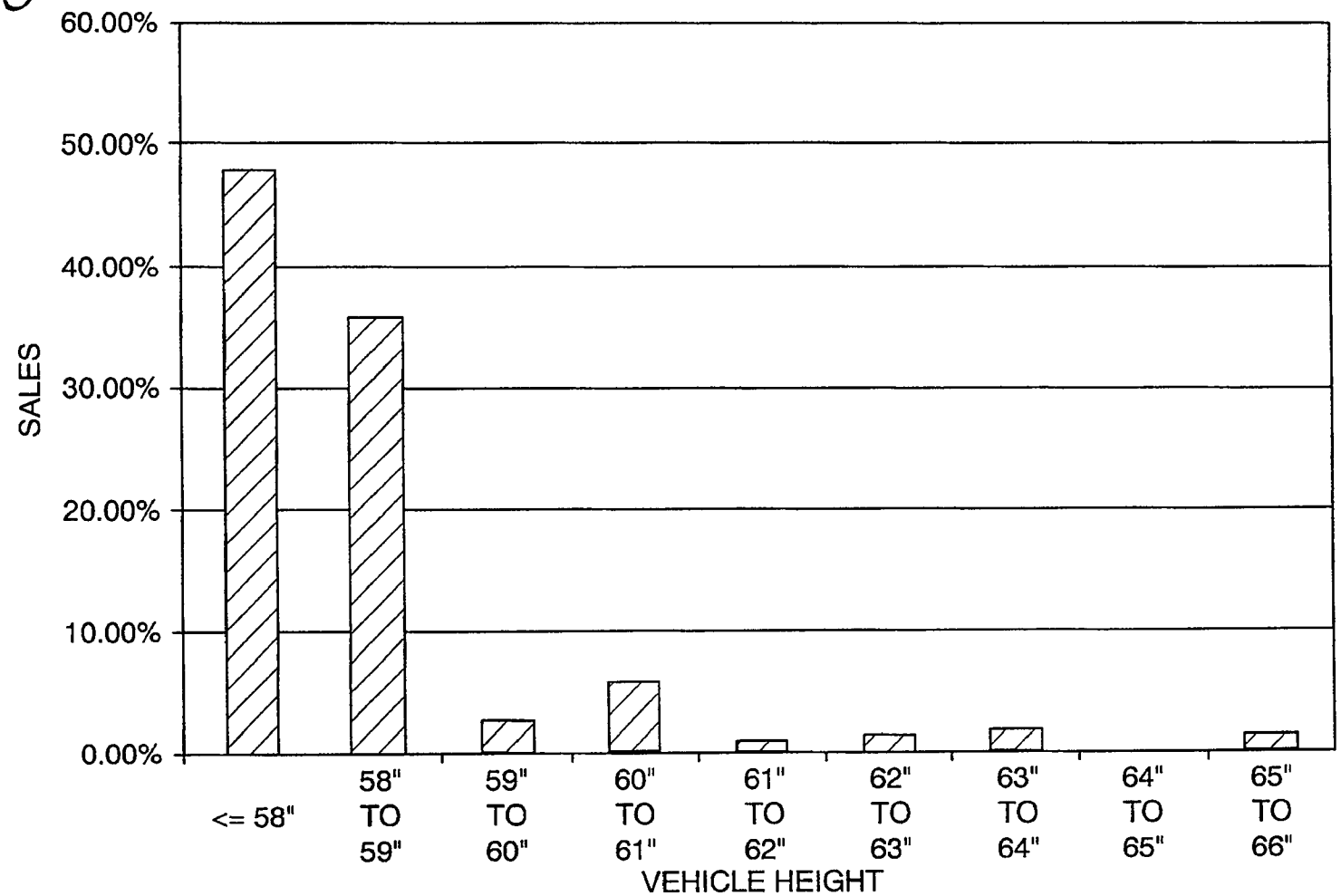
FIG. 9 illustrates the percentages of vehicles of various heights within a defined group of passenger cars.

To project vehicle heights and other relevant parameters for future new automotive vehicle sales, recent data on such parameters as well as industry trends may be taken into account. As an example of data that may be useful, Table 1 below provides data on vehicle height as a percentage of car and truck sales in the United States from January through November 2008. FIG. 9 illustrates this data graphically.

TABLE 1

Car and Truck Sales vs. Vehicle Height 2008

| Vehicle Height | Car & Truck Sales |
|---|---|
| <=58" | 25.28% |
| 58" to 59" | 18.92% |
| 59" to 60" | 1.40% |
| 60" to 61" | 3.12% |
| 61" to 62" | 0.52% |
| 62" to 63" | 0.70% |
| 63" to 64" | 0.96% |
| 64" to 65" | 0.76% |
| 65" to 66" | 0.72% |
| 66" to 67" | 1.25% |
| 67" to 68" | 1.25% |
| 68" to 69" | 2.64% |
| 69">= | 42.47% |

Table 1 shows that, according to this data, about 25.28% of cars and trucks sold in the United States in the first eleven months of 2008 had a height of less than or equal to 58 in, and about 18.92% had a height of between 58 and 59 in. Additional data is provided for other car and truck heights.

Figure 11:
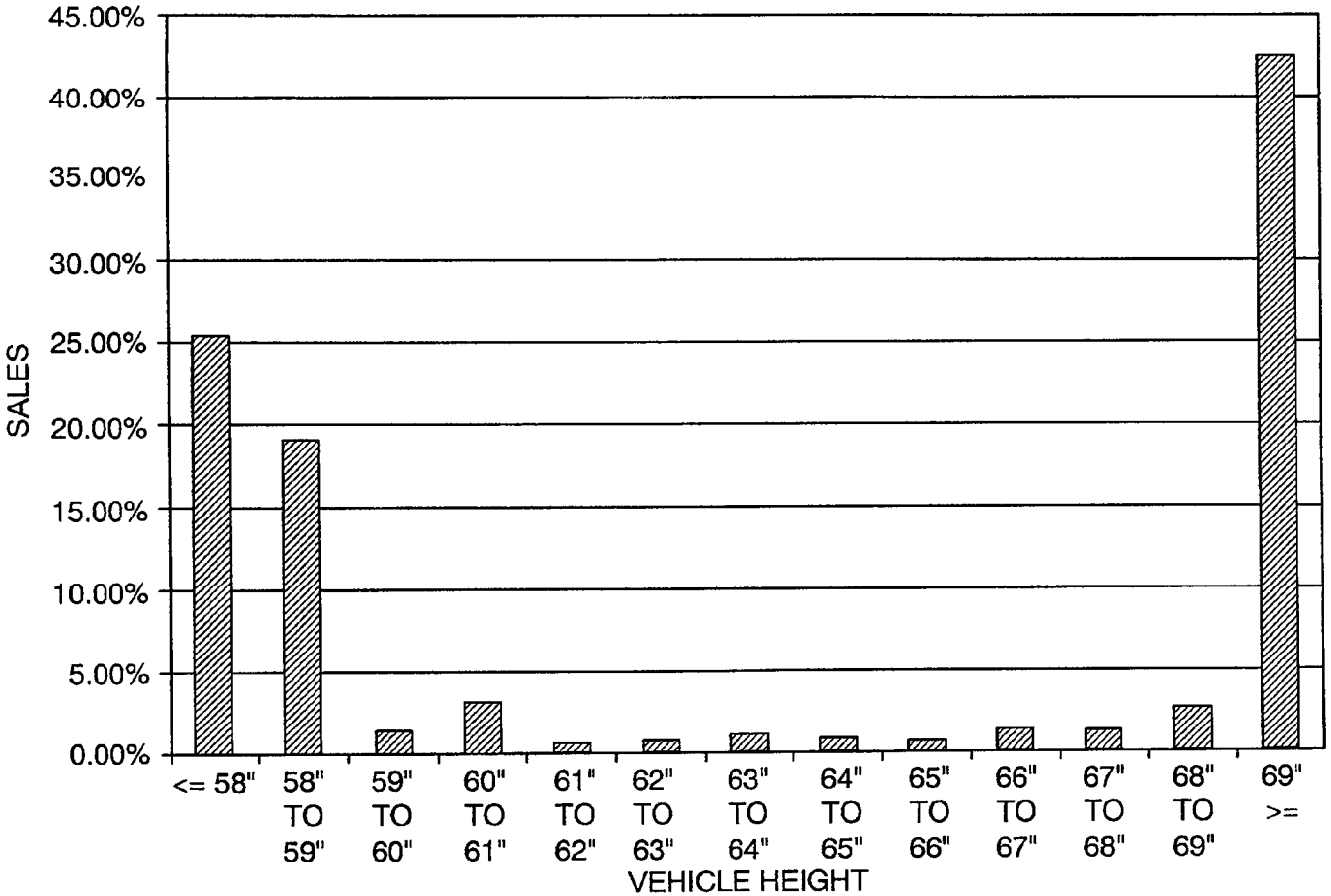
FIG. 11 illustrates the percentages of vehicles of various heights within a defined group of vehicles including passenger cars and trucks.

Table 2 provides a similar analysis specifically for cars. Table 2 indicates, for example, that 47.69% of cars sold in the United States in the first eleven months of 2008 had a height of less than 58 in. and that 35.7% had a height of between 58 and 59 in. Additional data is provided for other car heights. The data in Table 2 is illustrated graphically in FIG. 11.

TABLE 2

Car Sales vs. Vehicle Height 2008

| Vehicle Height | Car Sales |
|---|---|
| <=58" | 47.69% |
| 58" to 59" | 35.70% |
| 59" to 60" | 2.65% |
| 60" to 61" | 5.88% |
| 61" to 62" | 0.99% |
| 62" to 63" | 1.33% |
| 63" to 64" | 1.82% |
| 64" to 65" | 0% |
| 65" to 66" | 1.35% |

Two interesting conclusions that can be drawn from the data in Tables 1 and 2 are that the percentage of cars having heights above 61 in. is relatively low, and that the number of cars and trucks having heights from 61 to 66 in. is relatively low. In designing railcars to transport new automotive vehicles, data such as that in Table 1 and Table 2 may be used in conjunction with analysis of industry trends to guide decisions as to selection of deck height limitations.

In addition to assessment of vehicle heights for vehicles manufactured within a predetermined area and a predetermined time period, additional steps that may be taken to guide design of auto rack railcars preferably include assessing bottom clearance, vehicle weight, Cg and vehicle width for vehicles that may be transported on the auto rack railcars. The method of shipping automotive vehicles described herein preferably takes all of these factors into account in designing and building auto rack railcars.

The method also preferably comprises circus loading individual passenger cars onto a plurality of railcars, with each railcar having a load factor of at least 15 for a large percentage of passenger cars. The preferred railcar described herein is capable of commercial rail transport, with a load factor of at least 15, of over 90% of passenger cars included in the above data, without restriction as to where any of the individual passenger cars are positioned on the railcars, with the decks remaining fixed throughout loading, transportation and unloading of the cars. In some cases, it may be possible to load all three decks simultaneously at the departure point, and/or to unload all three decks simultaneously at the destination.

The railcars may be manufactured by various methods, e.g., (1) constructing new flat cars and new racks in an integrated manufacturing operation; (2) building racks on flat cars that have previously been used in commercial rail service; and (3) converting bi-level auto rack railcars into tri-level auto rack railcars.

The method of converting bi-level auto-rack railcars to tri-level auto rack railcars, may be advantageous where changes in consumer preferences lead to a long term reduced demand for shipment of automobiles by bi-level auto rack. A typical bi-level auto rack railcar comprises a flat car supporting a lower deck and a plurality of posts extending upward from the flat car to support an upper deck affixed thereto. A roof structure is affixed to and supported by the upper ends of the posts. The roof structure may comprise a pair of top chords or roof nails, and corrugated roof sheets extending therebetween. In one embodiment, the method comprises severing each of the posts between the flat car and the roof structure, thereby dividing the posts into upper and lower portions, possibly without disconnecting the upper portions of the posts from the roof structure; removing upper portions of the posts with the roof structure; removing the upper deck from the portions of the posts to which it was affixed; adjusting the height of the upper deck and affixing the upper deck to portions of the posts; affixing a second upper deck to portions of the posts; adding extensions to portions of the posts; and assembling the portions of the posts and the extensions.

The step of assembling the posts and extensions may comprise butt welding the posts to the post extensions and welding reinforcing plates some or all sides to the posts and extensions across the butt-welded joints on all sides.

Figure 10:
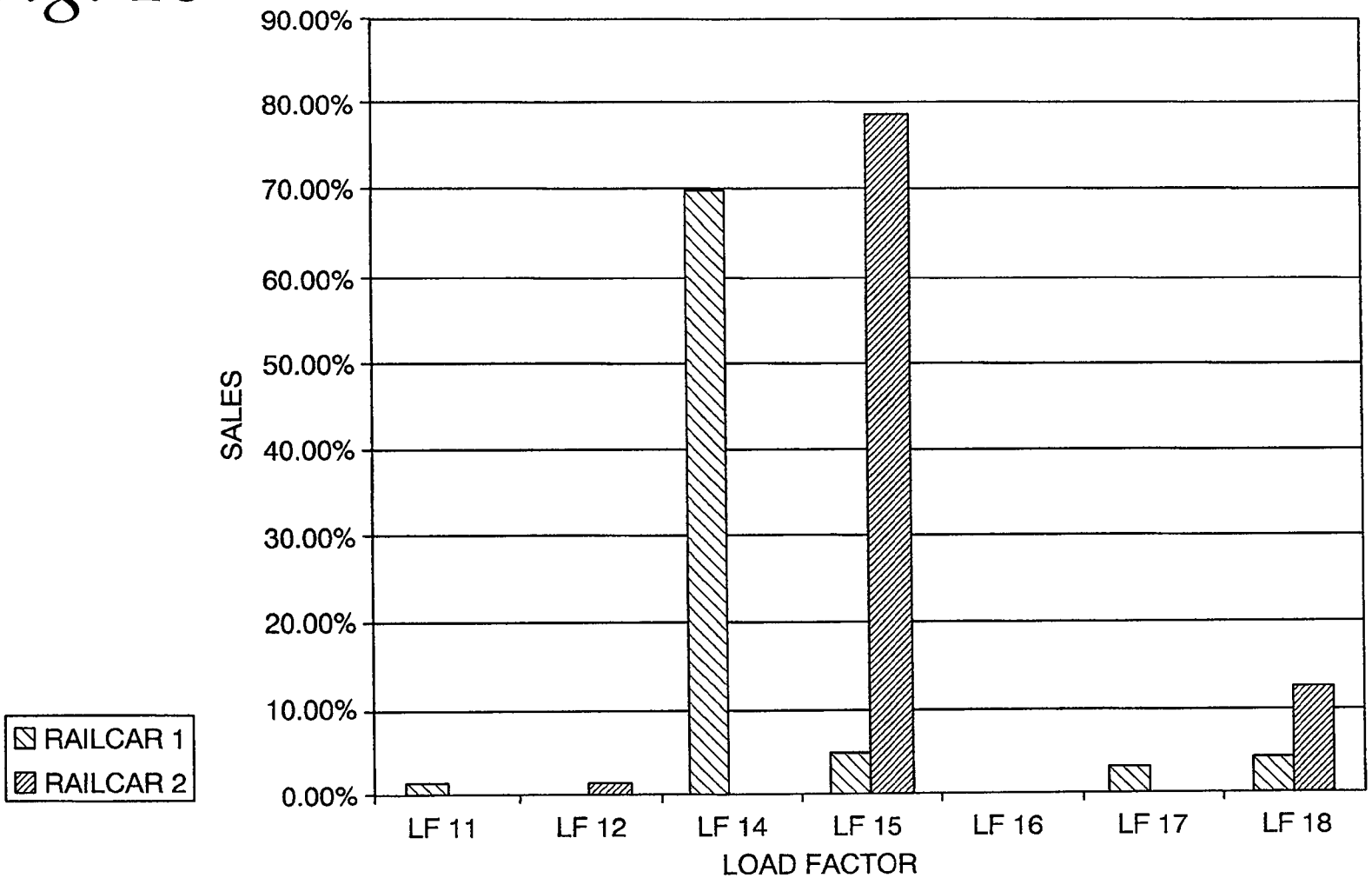
FIG. 10 illustrates the percentages of vehicles sold that may be carried with various load factors on each of two railcars.

Employing a railcar as described above can result in a dramatic increase in the percentage of passenger cars that can be transported with a load factor of at least 15, as shown in Table 3 below and illustrated in FIG. 10. In Table 3, Railcar 1 is a typical prior art tri-level auto rack railcar. Railcar 2 is a tri-level railcar having an overall height of 20' 2" built in accordance with the above description and as shown in FIGS. 4-8, on a flat car having a 39.5 in. ATR running surface, with a substantially horizontal A-deck and a minimum clearance of about 65. in. over each deck, such that vertical clearance of at least 4 in. is provided for automotive vehicles of up to 61 in. in height. The first column lists load factors (LF), and data in the columns labeled Railcar 1 and Railcar 2 indicate the percentages of passenger cars manufactured in the first eleven months of 2008 for each load factor, based on requiring vertical clearance of at least 4 in.

TABLE 3

Load Factors of Railcar 1 vs. Railcar 2

| | Railcar 1 | Railcar 2 |
|---|---|---|
| LF 11 | 1.33% | |
| LF 12 | | 1.33% |
| LF 13 | | |
| LF 14 | 69.87% | |
| LF 15 | 4.75% | 78.60% |
| LF 16 | | |
| LF 17 | 3.03% | |
| LF 18 | 3.84% | 12.29% |

Thus, Table 3 shows that Railcar 1 has a load factor of 15 for 4.75% of the cars, a load factor of 17 for 3.03%, and a load factor of 18 for only 3.84%. The total of the percentages for these three load factors is 11.62%. Thus, for Railcar 1, only about 11.62% of the passenger cars in the data set can be transported with a load factor of 15 or more. In contrast, the railcar described above is capable of transporting over 90% of the passenger cars in the data set with a load factor of 15 or more. It should be noted that, while the data Table 3 is based in part on requiring at least 4 in. of vertical clearance, it may be determined that a reduced amount of vertical clearance will be acceptable for Railcar 2 in view of the elimination of bouncing associated with travel over conventional ramps. This may further increase the percentages of vehicles associated with the indicated load factors.

From the foregoing, it is apparent that the preferred embodiments described above provide improved methods of shipping motor vehicles, improved auto rack railcars, and improved methods of manufacturing auto rack railcars. The invention is not limited to the preferred embodiments described above. The invention is further described in the following claims.

The invention claimed is:

1. A method of transporting newly manufactured passenger cars, comprising:

considering a predetermined area, which is the United States of America;

considering a predetermined time period;

determining a distribution of vehicle heights for passenger cars sold within said predetermined area and said predetermined time period;

assessing weight, bottom clearance, length, width and Cg for said passenger cars;

providing a plurality of single-unit tri-level auto rack railcars, each of said railcars comprising a flat car and a fixed-deck rack built on said flat car;

each of said railcars having (a) three decks on a flat car having 39.5" ATR running surface, the three decks being permanently fixed along their entire lengths and being capable of transporting in commercial rail service over 90% of passenger cars manufactured in said predetermined area and predetermined time period with a load factor of at least 15 with minimum vertical clearances to accommodate the vehicle heights of said over 90% of passenger cars, while also accommodating at least 3 in. of vertical displacement of said vehicles on their suspension systems on all three decks, said minimum vertical clearances being between 64 and 66 in. (b) substantially horizontal deck configurations to meet ground clearance requirements for said over 90% of passenger cars on all 3 decks, (c) minimum horizontal clearances to accommodate widths of said over 90% of passenger cars on all three decks, and (d) an overall height of 20'2";

circus loading individual passenger cars onto a plurality of said railcars with a load factor of at least 15 and without restriction as to which individual passenger cars are positioned on which decks, with said decks remaining fixed throughout said loading;

transporting said individual passenger cars from a point of origin to a destination by rail; and unloading said individual passenger cars at said destination using circus loading techniques, with said decks remaining fixed throughout said unloading operation.

2. The method of claim 1 wherein providing single-unit tri-level railcars comprises building racks on said flat cars that have previously been used in commercial rail service, and wherein building the racks comprises affixing a plurality of upstanding posts to each of said flat cars in a manner that accommodates differences in flat car configuration due to prior use in commercial rail service.

3. The method of claim 1 wherein said loading and unloading comprises loading and unloading all three decks simultaneously by employing three loading ramps at heights approximately corresponding respectively to the heights of said decks.

4. The method of claim 1 wherein the predetermined time period is a calendar year.

5. The method of claim 1 wherein the predetermined time period is a portion of a calendar year.

6. The method of claim 1 wherein the predetermined time period is January through November, 2008.

7. The method of claim 1 wherein providing single-unit tri-level railcars comprises converting bi-level autorack railcars to tri-level autorack railcars.

8. The method of claim 1 wherein the rack has at least one upper structural member that is made of a lighter weight material than at least one lower structural member.

9. The method of claim 1 wherein the rack comprises a plurality of lower structural members, a plurality of upper structural members, a plurality of non-structural lower side screens, and a plurality of non-structural upper side screens, and wherein said upper structural members and said upper side screens are of reduced weight relative to said lower side screens to lower the Cg of the railcar.

10. The method of claim 9 wherein at least one of the upper structural members and upper side screens are made of lighter weight materials than at least one of said lower structural members and said lower side screens.

11. The method of claim 10 wherein at least one of the upper structural members and upper side screens are made of aluminum and at least one of the lower structural members and lower side screens are made of steel.

12. The method of claim 9 wherein at least one of the upper structural members and upper side screens are made of lighter gauge materials than at least one of said lower structural members and said lower side screens.

* * * * *